United States Patent [19]

Lee

[11] Patent Number: 4,667,562

[45] Date of Patent: May 26, 1987

[54] HIGH-HAT CYMBAL LOCKING DEVICE

[76] Inventor: Roger A. Lee, 224 W. Stanton Rd., Quarryville, Pa. 17566

[21] Appl. No.: 887,330

[22] Filed: Jul. 21, 1986

[51] Int. Cl.[4] ..... G10D 13/06; G10G 5/00

[52] U.S. Cl. ..... 84/422 R; 84/421

[58] Field of Search ..... 84/402, 421, 422 H, 84/422 R

[56] References Cited

U.S. PATENT DOCUMENTS

| | | | |
|---|---|---|---|
| 1,596,495 | 8/1926 | Londe | 84/402 |
| 4,497,238 | 2/1985 | Dasovich | 84/421 |
| 4,517,876 | 5/1985 | Duhon | 84/422 R |
| 4,528,888 | 7/1985 | Hoshino | 84/421 |

*Primary Examiner*—Benjamin R. Fuller

*Attorney, Agent, or Firm*—H. Jay Spiegel

[57] ABSTRACT

The present invention relates to a high-hat cymbal locking device. The device is designed to be attachable to an existing high-hat cymbal assembly and includes an actuating rod having a device which may couple to the existing actuator for the high-hat cymbals. In one position of actuation of the present invention, the high-hat cymbal may operate as if the present invention was not associated therewith. In a second actuating position of the present invention, the top cymbal is pulled down to a position in engagement with the bottom cymbal and locked in that position until the present invention is actuated to the first mentioned position of actuation thereof whereupon free actuation of the high-hat cymbals may be undertaken.

5 Claims, 8 Drawing Figures

Fig. 1
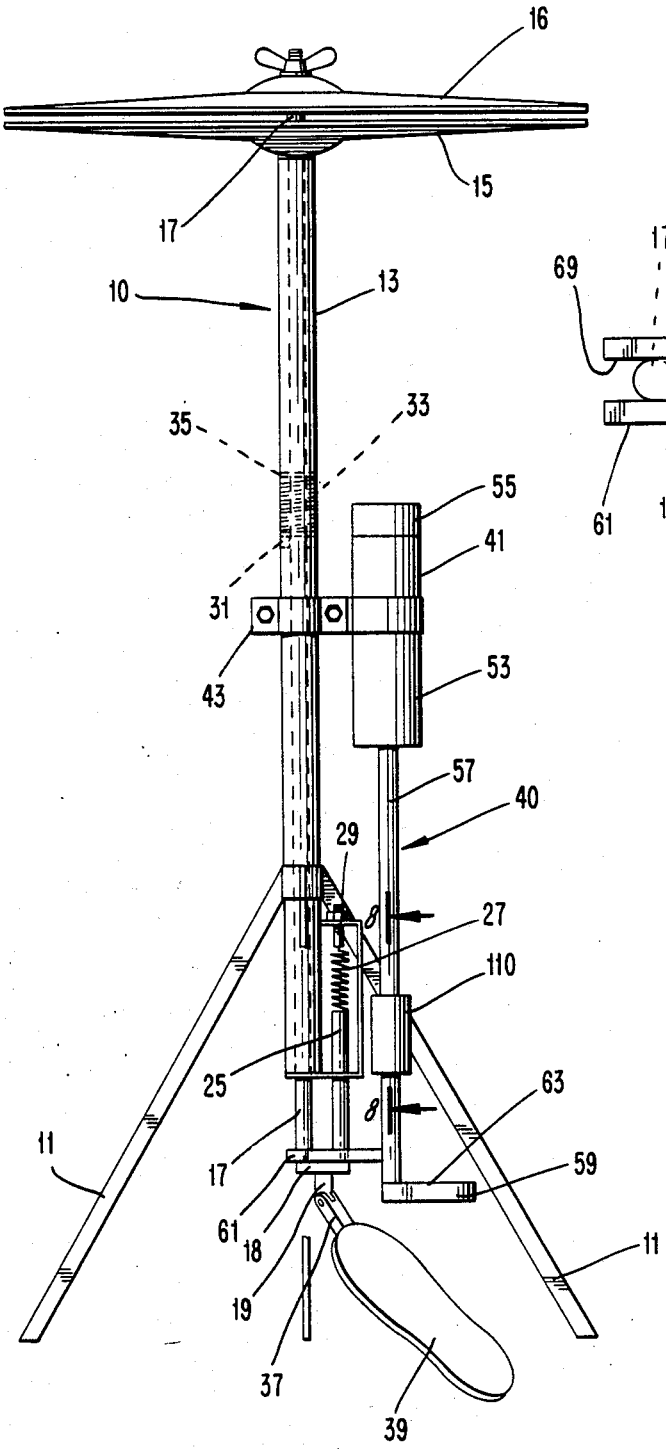
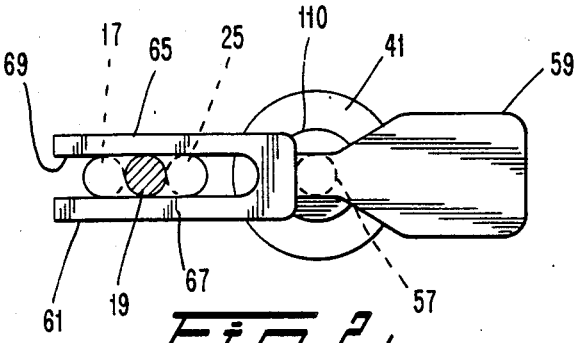
Fig. 2
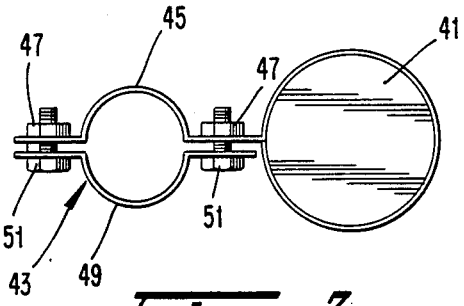
Fig. 3

55
57
83
41
87
87
85
85
89
81
91
79
91
93
5
5
77
95
105
71
73
53
75
57

Fig. 5
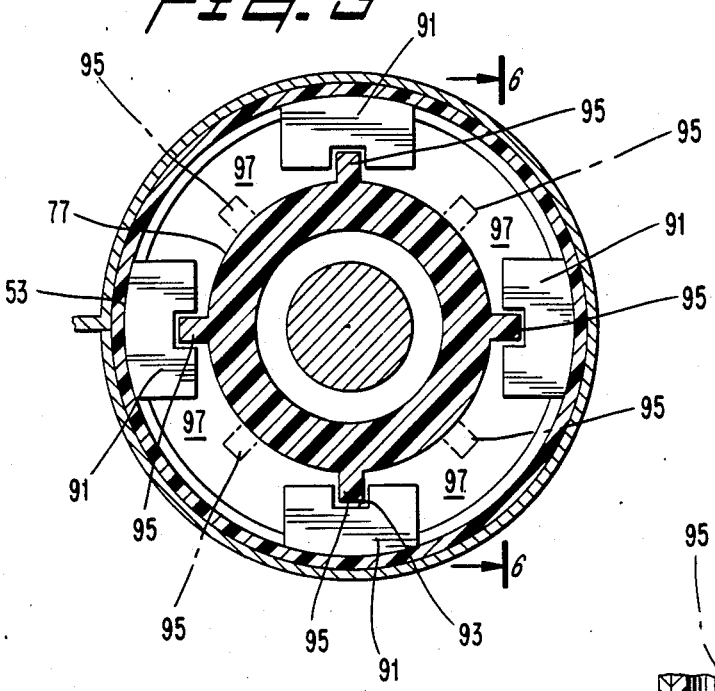
Fig. 6
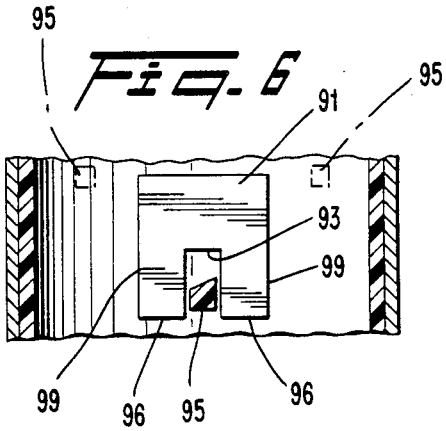
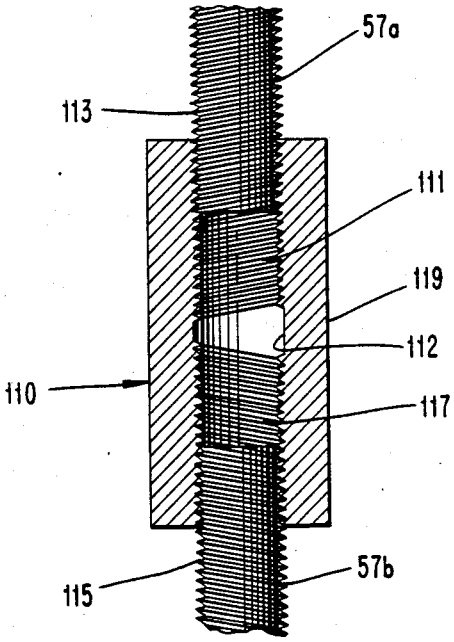
Fig. 8
Fig. 7
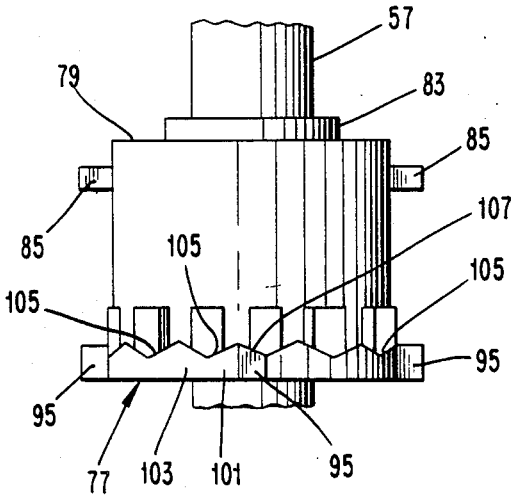

HIGH-HAT CYMBAL LOCKING DEVICE

BACKGROUND OF THE INVENTION

The present invention relate to a high-hat cymbal locking device. In recent years, drummers have assembled drum sets including either two bass drums or a double bass pedal for a single drum. Such an association of drums may cause the drummer problems because with the drummer having one foot on each of two bass drum pedals, he or she cannot keep the high-hat cymbals closed because both feet are occupied. Thus, a need has developed for a new piece of percussion hardware which may be attached to an existing high-hat cymbal which enables the high-hat cymbals to be held in a locked position together while the drummer's feet are occupied on the two bass drum pedals. Thus, in this light, the present invention was developed.

Applicant is aware of the following prior art:

U.S. Pat. No. 1,596,495 to La Londe discloses a cymbal holding device wherein the cymbal and its muting device are mounted on arms which may be selectively reciprocated on a vertical rod so as to adjust their relative position with respect to one another. The invention disclosed by La Londe is believed to be materially different from the teachings of the present invention since there is no means to selectively actuate the elements by a foot pedal and loosening and tightening of wing nuts is an extremely cumbersome procedure especially in the middle of the playing of a music selection.

U.S. Pat. No. 4,528,888 to Hoshino discloses a high hat cymbal system including actuating means to selectively move the cymbals together or apart and an adjusting means to adjust the relative position of the cymbals with respect to one another. The present invention is believed to be distinctly different from the teachings of this patent since the patent fails to disclose any means to selectively lock the cymbals together through the use of a pedal actuator.

SUMMARY OF THE INVENTION

Accordingly, the present invention has been developed so as to overcome the deficiencies of the prior art and so as to provide a device which may be attached to an existing high-hat cymbal so as to enable the selective locking of the cymbals together and selective release from such locking.

The present invention includes the following elements:

(a) In a first aspect of the present invention, a cylinder is provided which may be rigidly attached to the upstanding elongated hollow cylindrical pipe of the existing cymbal. Within the cylinder is located an actuating mechanism including a rod depending therefrom.

(b) The actuating mechanism operates in a similar fashion to the operating mechanism of a ball-point pen wherein a first acutation of the rod downwardly will cause the rod upon release of downward pressure to lock in a lower position and whereupon a further reciprocation of the rod downwardly and then a release thereof will result in the rod reciprocating upwardly to an upper position. The specific operation of the actuating mechanism within the cylinder will be described in greater detail hereinafter.

(c) The actuating rod has a pedal at its lowermost end which is adapted to be reciprocated by pressure placed thereon by the foot of the drummer. Above the foot pedal on the rod and extending radially outwardly therefrom on a radially opposite side of the rod from the foot pedal is a coupling member which may be shaped generally in the shape of a horseshoe and which is adapted to be coupled to the existing actuating mechanism of the existing high-hat cymbal device. With the rod coupled to the existing actuating device for the existing high-hat cymbal device, reciprocation of the pedal of the actuating mechanism of the present invention will result in locking of the cymbals together while a further downward reciprocation and then release of the foot pedal of the present invention will result in releasing of the coupling member from the high-hat cymbal actuating device to thereby allow the high-hat cymbal device to resume its normal operation.

(d) In a further aspect, the rod may have a clevistype device associated therewith which may be selectively actuated to increase or decrease the effective length of the rod. Through adjustments of the clevis-type device, and through the interaction of the coupling member with the existing high-hat cymbal actuating device, one may adjust the spacing of the cymbals from one another when they are at rest.

These and other objects, aspects and advantages of the present invention will be better understood from the following detailed description of the preferred embodiments when read in conjunction with the appended drawing figures.

BRIEF DESCRIPTION OF THE DRAWINGS

FIG. 1 shows a perspective view of an existing high-hat cymbal with the present invention attached thereto.

FIG. 2 shows a bottom view of the present invention showing details of the coupling member and the foot pedal actuator.

FIG. 3 shows a top view of the present invention showing in detail the cylinder and the device for mounting the present invention on the existing high-hat cymbal device.

FIG. 5 shows a cross sectional view along the line 5—5 of FIG. 4.

FIG. 6 shows a side view of a portion of the structure shown in FIG. 4.

FIG. 7 shows a further side view of other structure shown in FIG. 4.

FIG. 8 shows a cross-sectional view along the line 8—8 of FIG. 1.

SPECIFIC DESCRIPTION OF THE PREFERRED EMBODIMENTS

Figure 4:
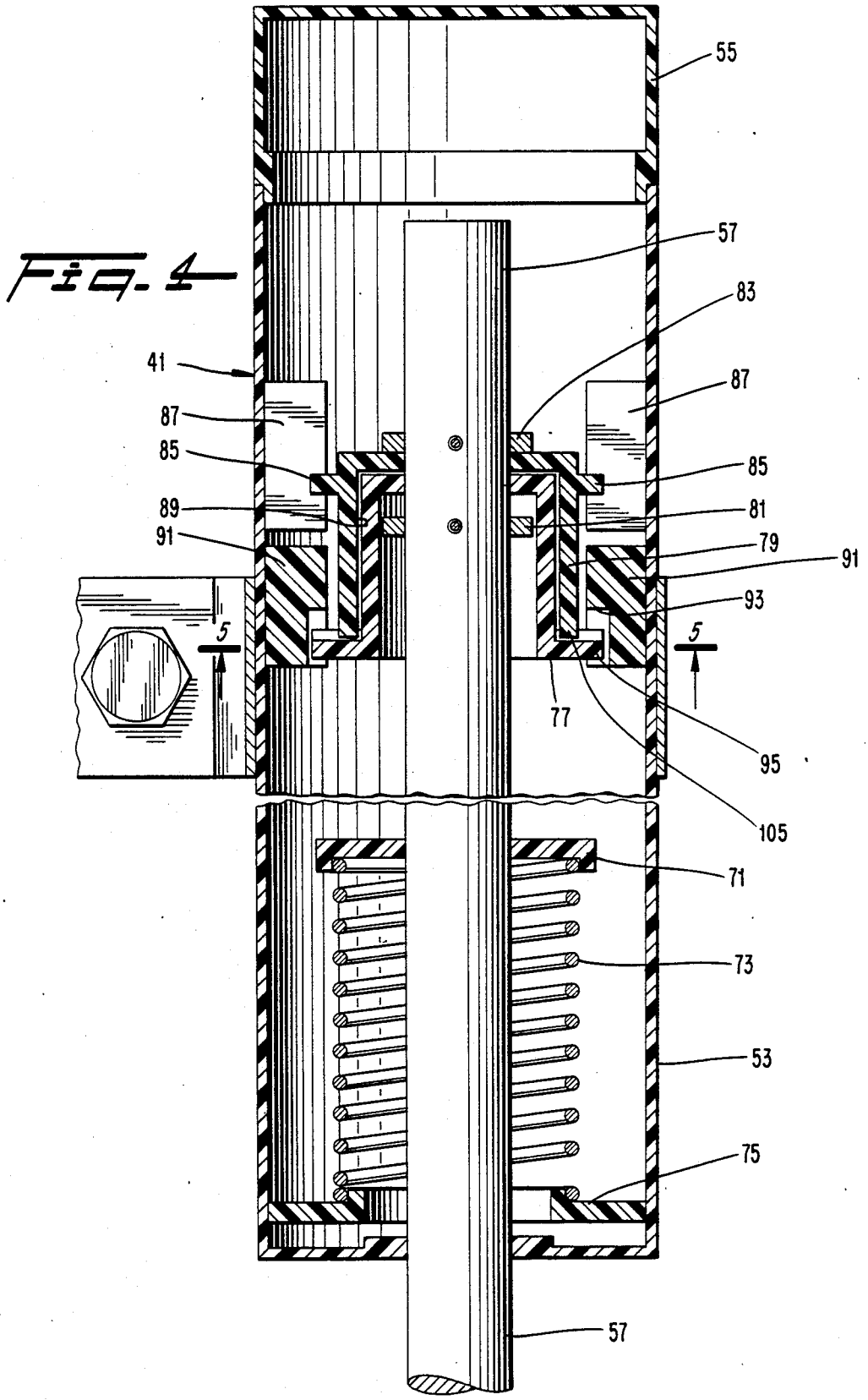
FIG. 4 shows a cross-sectional view through the cylinder shown in FIG. 1.

With reference first to FIG. 1, the existing high-hat cymbal device 10 is seen to include a tripod 11 designed to support the device 10, an elongated upstanding pipe 13 having a passageway therethrough and having attached thereto a lower cymbal 15. A rod 17 extends through the passageway within the pipe 13 and has attached at its upper end an upper cymbal 16. The rod 17 at its lower end is attached to a link member 18 with the rod 25 also being attached to the link member 18. The rod 25 also has attached thereto a tension spring 27 which may be adjusted through an adjustable bolt 29 so as to render adjustable the force of the spring 27. Within the passageway through the pipe 13, a shoulder 31 is formed on which engages a spring 33 which bears against a shoulder 35 formed on the rod 17. Thus, the combination of the springs 33 and 27 acts to bias the upper cymbal 16 upwardly away from engagement with the cymbal 15.

The link 19 is attached to a further link 37 which is attached at its distal end to an actuating foot pedal 39. As should be understood by those skilled in the art, depression of the foot pedal 39 downwardly will result in reciprocation of the rod 17 downwardly against the force of springs 27 and 33 to thereby reciprocate the upper cymbal 16 into engagement with the lower cymbal 15 to achieve the desired percussive effect. When the foot pedal 39 is released by the drummer, the combined force of the springs 27 and 33 will cause the upper cymbal 16 via the rod 17 to be reciprocated upwardly and away from engagement with the lower cymbal 15 in a manner well known to those skilled in the art.

Now, with reference to FIGS. 1–8, the present invention generally designated by the reference numeral 40 includes a cylinder 41 which is adapted to be removably attached to the pipe 13 by a bracket 43 . With reference to FIG. 3, the bracket 43 is seen to include a first arm 45 having holes 47 therein and being integrally attached to the cylinder 41. A further arm 49 is also provided which holes 51 which are alignable with the holes 47 in the arm 45. When the holes 47 and 51 are aligned, also aligned on the respective arms 45 and 47 are curved portions which combine to enable the bracket 43 to be adapted to be clamped in surrounding relation about the pipe 13.

The cylinder 41 includes a bottom portion 53 and a removable cap 55 which is provided for a purpose to be described hereinafter. Extending downwardly from the cylinder 41 is an actuating rod 57 having connected at its distal end a foot pedal 59 and a coupling member 61. With reference to FIG. 2, it is seen that the foot pedal 59 extends in one radial direction from the rod 57 and may include a roughened surface 63 so as to facilitate the frictional engagement of the foot pedal 63 with the foot of the drummer for enhanced effectiveness. With further reference to FIG. 2, it is seen that the coupling member 61 extends radially outwardly from the rod 57 in a direction spaced from the direction of radial elongation of the foot pedal 63 by about 180° . The coupling member 61 may be shaped somewhat like a horseshoe with two legs 65 and 67. As seen in FIG. 2, the opening 69 within the coupling device 61 is designed so as to enable it to slidably surround the rods 17 and 25 so that the invention 40 may assume one position wherein it has no effect upon the normal actuation of the high-hat cymbal device 10.

With reference now to FIG. 4, it is seen that the cylinder 41 includes a mechanism therein for selectively controlling the fixed position of the rod 57. As seen in FIG. 4, the rod 57 extends upwardly near the cap 55 of the cylinder 41 and includes an annular washer 71 affixed thereto against which is resiliently engaged a spring 73 which bears at its other end against a shoulder 75 extending inwardly from the lower casing 53. Thus, the spring 73 biases the rod 57 upwardly in the view shown in FIG. 4.

The rod has attached thereto a pair of annular members 77 and 79. These members are attached to the rod 57 by virtue of a lower ring 81 and an upper ring 83 which may be mounted in surrounding relation to the annular members 77 and 79 by any suitable means such as set screws, welding, threaded connections and the like. The annular member 79 includes a pair of radially outwardly extending tabs 85 which cooperate with inwardly formed guide W ribs 87 so as to constrain the annular member 79 to reciprocate without rotating. It is noted that only one rib 87 is shown in each side of FIG. 4 but it should be understood that on each side of FIG. 4, two ribs 87 are formed, one on each side of the respective tab 85.

The annular member 77 is mounted within an opening 89 formed within the annular member 79. As may be understood with reference to FIGS. 4, 5, 6 and 7, the interaction of the annular members 77 and 79 with each other and with the cylindrical casing 41 is similar to the actuation motion of a typical ball-point pen. In particular, with reference to FIG. 5, a plurality of inwardly extending protrusions 91 are formed on the inner walls of the casing 53. Each such structure 91 includes a recess 93 therein into which a protrusion 95 extending radially outwardly from the annular member 77 may be selectively inserted. Furthermore, as best seen in FIG. 5, spaces 97 exist between the structures 91 so that rotation of the annular member 77 about its axis by one-eighth of a turn in the view of FIG. 5 would result in the protrusions 95 being located within the spaces 97 so that the spring 73 may move the rod 57 upwardly along the walls 99 of the structures 91 above the uppermost level of the recesses 93 thereof.

With further reference to FIG. 7, it is seen that the annular member 77 has an annular ring-like portion 101 having a plurality of pointed recesses therein designated by the reference numeral 103 and into which pointed protrusions 105 extending downwardly from the annular member 79 may interface. It is important to note that the protrusions 95 have angled cam surfaces 107 thereon which may interact with the protrusions 105 of the annular member 79 such that the interaction thereof when the rod 57 is moved downwardly causes rotation of the annular member 77 with respect to the annular member 79. Thus, in the view of FIG. 4, when the rod 57 is pulled downwardly by the downward movement of the foot pedal 59, shown in FIG. 1, the upper ring 83 fixedly mounted to the rod 57 will pull the annular members 77 and 79 together until the protrusions 95 of the annular members 77 are released from the recesses 93 whereupon the interaction between the cam surfaces 107 of the protrusions 95 and the protrusions 105 of the annular member 79 will result in the annular member 77 being rotated one-eighth of a turn with respect to the annular member 79 which may not rotate due to the interaction of the tabs 85 and the ribs 87. Thus, with the protrusions 95 assuming the phantom line postion shown in FIG. 5, the spring 73 may reciprocate the rod 57 upwardly until the protrusions 95 are in the phantom position shown in FIG. 6.

With the device in such a position, a further reciprocation of the rod 57 downwardly against the upward force of the spring 73 will cause the protrusions 95 to be located below the bottom surface 96 (FIG. 6) of the structures 91 whereupon the interaction of the cam surfaces 107 of the protrusions 95 and the pointed protrusions 105 of the annular member 79 will result in a further rotation of the annular member 77 with respect to the annular member 79 one-eighth of a turn to thereby align the protrusions 95 with the recesses 93 as shown in FIGS. 5 and 6, whereupon the rod 57 will be locked in its downward position.

With this actuation in mind, further reference is made to FIG. 1 wherein it is seen that the link 19 includes a top platform 18 over which the coupling member 61 lies. Thus, with the actuating device contained within the cylinder 41 actuated to a position where the protrusions 95 are in the orientation shown in phantom in FIG. 6, the coupling member 61 will be in its uppermost position and will not impede the normal actuation of the high-hat cymbal device 10. If it is desired, however, to lock the cymbals 15 and 16 together, the pedal 59 is reciprocated downwardly until the protrusions 95 are below the surface 96 of the structures 91 whereupon the interaction between the cam surfaces 107 and the protrusions 105 will cause rotation of the annular member 77 one-eighth of a turn until the protrusions 95 are locked within the recesses 93 as shown in FIGS. 5 and 6, whereupon this actuation will have caused the coupling member 61 to have moved downwardly in the view of FIG. 1 to thereby reciprocate downwardly the rod 17 to thereby lock the cymbals 15 and 16 in an engaged position together.

Sometimes, the drummer finds it desirable to be able to selectively position the spacing of the cymbals 5 and 16 before actuation through the use of the pedal 9. For this, the rod 57 may be provided with a clevis-type adjusting device 110 which is best seen in FIG. 8. As shown, in FIG. 8, the rod 57 is made of two pieces with the upper piece 57*a* having left-hand threads 111 which are complimentary to the left-hand threads 113 contained within the passageway 112 through the device 110. Furthermore, the lower rod portion 57*b* includes righthanded threads 115 which are complimentary to the right-handed threads 117 contained within the lower portion of the passageway 112 through the device 110. With this structure in mind, it should be understood that rotation of the sleeve 119 in one direction will cause the rod portions 57*a* and 57*b* to move apart from one another whereas rotation of the sleeve 119 in the opposite direction will result in the rod portions 57*a* and 57*b* reciprocating toward one another. Thus, through selective rotations of the sleeve 119, the effective length of the rod 57 may be adjusted and through this mechanism the rod 57 may be lengthened to an extent whereupon the coupling member 61 may reciprocate the rod 17 and thereby the cymbal 16 downwardly toward the cymbal 15 while the mechanism within the cylinder 41 is in the position corresponding to the position of the protrusions 95 shown in phantom in FIG. 6. This selective lengthening or shortening of the effective length of the rod 57 is quite helpful to drummers who wish to vary the spacing of the cymbals 15 and 16.

Accordingly, it should be understood that with the present invention 40 installed on an existing high-hat cymbal device 10, it is possible to lock the cymbals 15 and 16 together without having to hold a foot on the pedal 39 so that both feet are available to actuate the dual bass pedals which are commonly used in today's drum sets. When it is desired to separate the cymbals 15 and 16 so that they may be selectively actuated through the use of the pedal 39, the drummer must merely push down slightly on the pedal 59 a sufficient distance to unlock the protrusions 95 from the recesses 93 whereupon the cam action between the surfaces 105 and the protrusions 107 will result in movements of the protrusions 95 to the phantom position shown in FIG. 5 whereupon the rod 57 and coupling member 61 will be reciprocated upwardly to thereby disengage the device 40.

Of course, various changes, modifications and alterations in the teachings of the present invention may be contemplated by those skilled in the art without departing from the intended spirit and scope of the present invention. For example, other devices besides the device 110 may be utilized to enable the selective alteration of the effective length of the rod 57. Furthermore, the device 110 may be located anywhere along the length of the rod 57 including within the cylinder, for example between the elements 71 and 81. As should be understood, the spring 73 should be stronger than the combined strength of the spring 27, 33 of the device 10 to ensure effectiveness of operation. Finally, while the present invention is disclosed as an add-on device, it may just as well be made with the device 10 at the time of manufacture. Accordingly, it is intended that the present invention only be limited by the terms of the appended claims.

I claim:

1. In a high-hat cymbal device including an elongated tube, support means at a lower end of said tube, a first fixed cymbal mounted on an upper end of said tube, an actuating rod extending through said tube and having a second cymbal mounted on its upper end and actuating means for said second cymbal mounted on a lower end of said rod, said actuating means including a link attached to said rod and having an upwardly facing shoulder, the improvement comprising a locking device to releasably lock said cymbals in engagement with one another and including:

(a) locking means operable on said second cymbal actuating means and movable between a first position wherein said locking means is disengaged from said second cymbal actuating means and a second position wherein said locking means is operable to move said actuating means to a position wherein said second cymbal is locked into engagement with said first cymbal; and (b) actuator means for said locking means for moving said locking means between said first and second positions said actuator means comprising:

(1) a U-shaped member mounted in overlying relation to said shoulder;

(2) a rod member attached to said U-shaped member; and (3) a foot pedal attached to said rod member;

(4) said rod member forming a part of said locking means; and (5) said actuator means releasably engaging said shoulder.

2. The invention of claim 1, wherein said locking means comprises:

(a) a housing into which extends said rod member;

(b) a cam device mounted on said rod member in said housing and having a first cam member constrained to reciprocate non-rotatably with said rod member, and a second cam member constrained to reciprocate with said rod member and rotatable with respect to said rod member;

(c) said second cam member including protrusion means extending radially outwardly therefrom; and (d) recess means extending radially inwardly from said housing, said second cam member being rotatable with respect to said first cam member due to cam interaction therebetween to move said protrusion means between a first position wherein said protrusion means is engaged in said recess means and a second position, wherein said recess means is spaced from said recess means, and (e) biasing means operable to bias said rod member to an upper position in said second position of said second cam member and operable to bias said protrusion means into engagement with said recess means in said first position of said second cam member.

3. The invention of claim 1, further including means for adjusting the length of said rod member.

4. The invention of claim 2, wherein said housing is releasably attached to said tube.

5. The invention of claim 2, further wherein said cymbal device includes a biasing member for biasing said second cymbal in a direction away from said first cymbal, said biasing means exerting a greater force than said biasing member.

* * * * *